US009004139B2

(12) United States Patent
Wu et al.

(10) Patent No.: US 9,004,139 B2
(45) Date of Patent: Apr. 14, 2015

(54) TWO-WAY UP-DOWN CURTAIN

(71) Applicants: Ching-Yuan Wu, Xihu Township, Changhua County (TW); Wu-Chung Nine, Fuxing Township, Changhua County (TW)

(72) Inventors: Ching-Yuan Wu, Xihu Township, Changhua County (TW); Wu-Chung Nine, Fuxing Township, Changhua County (TW)

(73) Assignee: Ching Feng Home Fashions Co., Ltd., Fu-Nan Village, Fu Hsing, Chang-Hwa (TW)

( * ) Notice: Subject to any disclaimer, the term of this patent is extended or adjusted under 35 U.S.C. 154(b) by 173 days.

(21) Appl. No.: 13/684,748

(22) Filed: Nov. 26, 2012

(65) Prior Publication Data

US 2014/0144596 A1 May 29, 2014

(51) Int. Cl.

| | |
|---|---|
| ***E06B 3/48*** | (2006.01) |
| ***E06B 9/262*** | (2006.01) |
| ***E06B 9/322*** | (2006.01) |
| ***E06B 9/38*** | (2006.01) |

(52) U.S. Cl.

CPC ..... *E06B 9/262* (2013.01); *E06B 9/322* (2013.01); *E06B 9/38* (2013.01); *E06B 2009/3222* (2013.01); *E06B 2009/3227* (2013.01)

(58) Field of Classification Search

CPC ..... E06B 9/388; E06B 9/322; E06B 9/262; E06B 9/38; E06B 2009/3222

USPC ..... 160/84.03, 167 R, 170, 171

See application file for complete search history.

(56) References Cited

U.S. PATENT DOCUMENTS

| | | | | |
|---|---|---|---|---|
| 4,953,610 | A * | 9/1990 | Phillips et al. | 160/84.03 |
| 6,854,502 | B2 * | 2/2005 | Lai | 160/89 |
| 7,143,802 | B2 * | 12/2006 | Strand et al. | 160/84.04 |
| 7,406,995 | B2 * | 8/2008 | Huang | 160/170 |
| 8,561,665 | B2 * | 10/2013 | Lin | 160/84.03 |
| 2008/0083509 | A1 * | 4/2008 | Hsu et al. | 160/84.05 |
| 2008/0196843 | A1 * | 8/2008 | Nien et al. | 160/178.1 R |
| 2008/0216967 | A1 * | 9/2008 | Liang et al. | 160/168.1 V |
| 2011/0265962 | A1 * | 11/2011 | Drew et al. | 160/340 |

* cited by examiner

*Primary Examiner* — Katherine Mitchell
*Assistant Examiner* — Abe Massad
(74) *Attorney, Agent, or Firm* — Egbert Law Offices, PLLC

(57) ABSTRACT

A two-way up-down curtain includes a fixed top base including a device space and its bottom is drilled several eyelets. A coil rope control device is located in the device space is coiled with a first and a second thread. The threads penetrate through the eyelet in the bottom of the fixed top base. A curtain under the fixed top base includes a mobile top, a bottom and a curtain. The first thread penetrates through the mobile top, curtain and bottom downwards, and through the bottom downwards with an extended end. A pulling base is only fixed to the extended end of the first thread mutually, so that the user can push and pull the mobile top or the pulling base by hand to change the state of the curtain. The mobile top can be actually prevented from moving to result in clearance to the fixed top base.

3 Claims, 7 Drawing Sheets

TWO-WAY UP-DOWN CURTAIN

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO APPENDIX SUBMITTED ON COMPACT DISC

Not applicable.

BACKGROUND OF THE INVENTION

1. Field of the Invention

The present invention relates generally to curtain structure and more particularly to an innovative structural design of a two-way up-down curtain.

2. Description of Related Art Including Information Disclosed Under 37 CFR 1.97 and 37 CFR 1.98.

Generally, windows in houses or work places are equipped with curtains (e.g. rolling screen, cloth curtain, Roman curtain, blind and so on). They can prevent the light from penetrating through the windows into the rooms, and prevent others from looking into the rooms. For the known curtains, a pull rope controls the lift and drop of the curtain for shielding effect, but the sunlight shoots into the room through the bottom of the window at a low angle at dusk. If the curtain is dropped to the lowest level, the whole window is shielded and the room will be dark and stuffy. Therefore, a two-way up-down curtain is developed by some practitioners.

Taking a general view of known two-way up-down curtains, they usually consist of a fixed top base 01, a coil rope controller inside the fixed top base 01, a mobile top 02, a bottom 03 and a curtain 04 connecting the mobile top 02 to the bottom 03. The coil rope controller goes through the mobile top 02, curtain 04 and bottom 03 by a thread. Thereby, the user can adjust the state of the curtain 04 by pushing and pulling the mobile top 02 or bottom 03 by hand. However, this known structure type still has the below mentioned problems according to practical experience. As shown in FIG. 1, when the user pulls the bottom 03 to unfold the curtain 04 to the lowest point, he often keeps applying a downward force to the bottom 01 as a natural action or to make sure the curtain 04 cannot be unfolded anymore. However, the mobile top 02, curtain 04 and bottom 03 are interconnected, when the curtain 04 cannot spread anymore, if the user still pulls the bottom 03 downwards, the curtain 04 and the mobile top 02 will move down accordingly, so that a clearance occurs between the fixed top base 01 and mobile top 02 (see H in the figure), and then the shielding effect is lost, and the user has to make another adjustment.

Thus, to overcome the aforementioned problems of the prior art, it would be an advancement if the art to provide an improved, structure that can significantly improve the efficacy.

Therefore, the inventor has provided the present invention of practicability after deliberate design and evaluation based on years of experience in the production, development and design of related products.

BRIEF SUMMARY OF THE INVENTION

The improved structure of a two-way up-down curtain of this invention has a pulling base at the bottom of the curtain, and the pulling base is only fixed to the extended end of the first thread mutually as an innovative structure design. In comparison to the prior art technology mentioned above, when the user pulls the pulling base to fully expand the curtain downwards, if he continues to apply a force to the pulling base (applying a downward force to the pulling base probably as a natural action or in order to make sure the curtain cannot be unfolded anymore), only the first thread will be pulled, the curtain and the mobile top will not move, so as to avoid clearance between the moved mobile top and the fixed top base for more convenient and practical unobviousness.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 2:
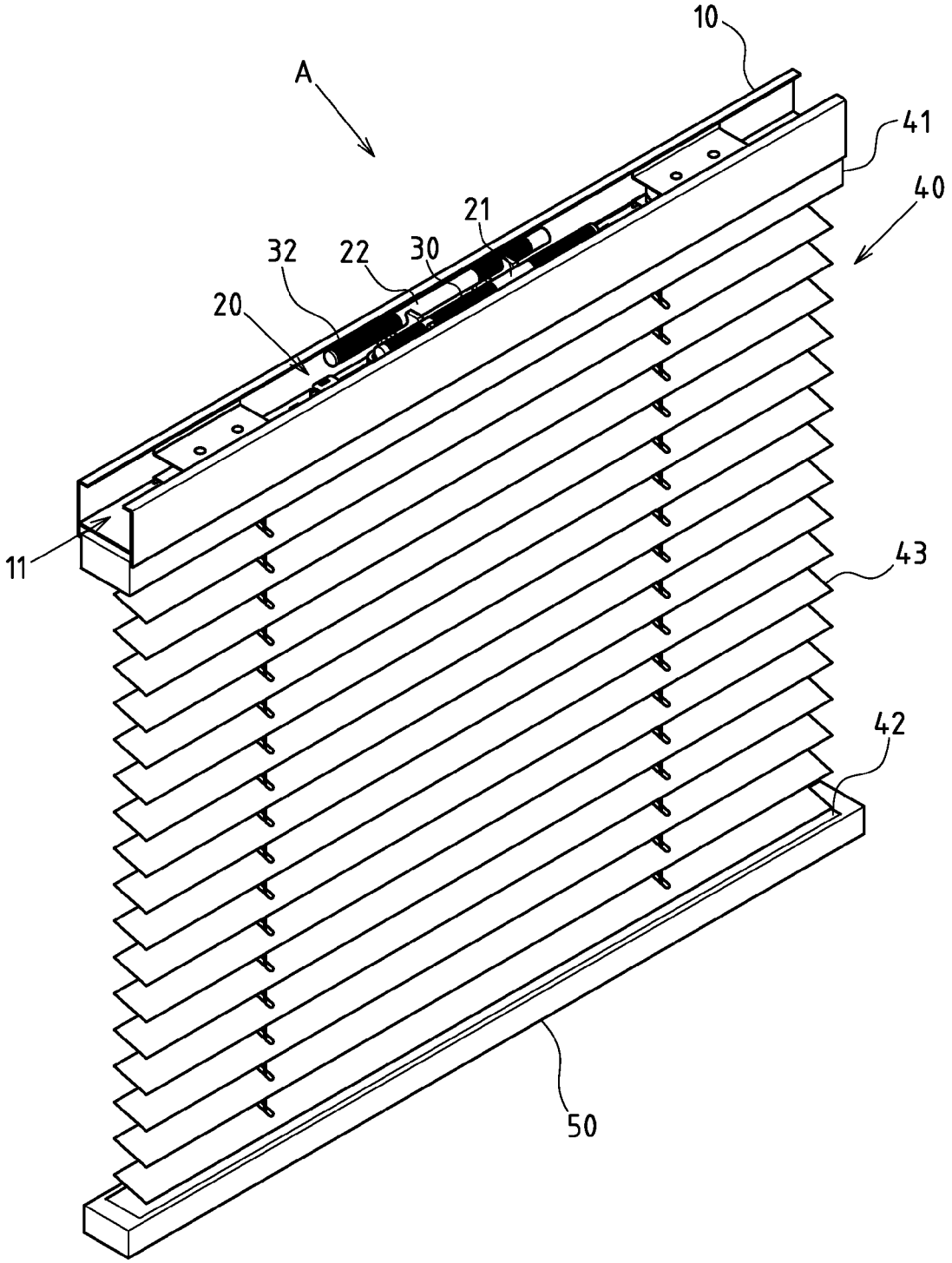
FIG. 2 is an upper perspective view of the present invention.
Figure 3:
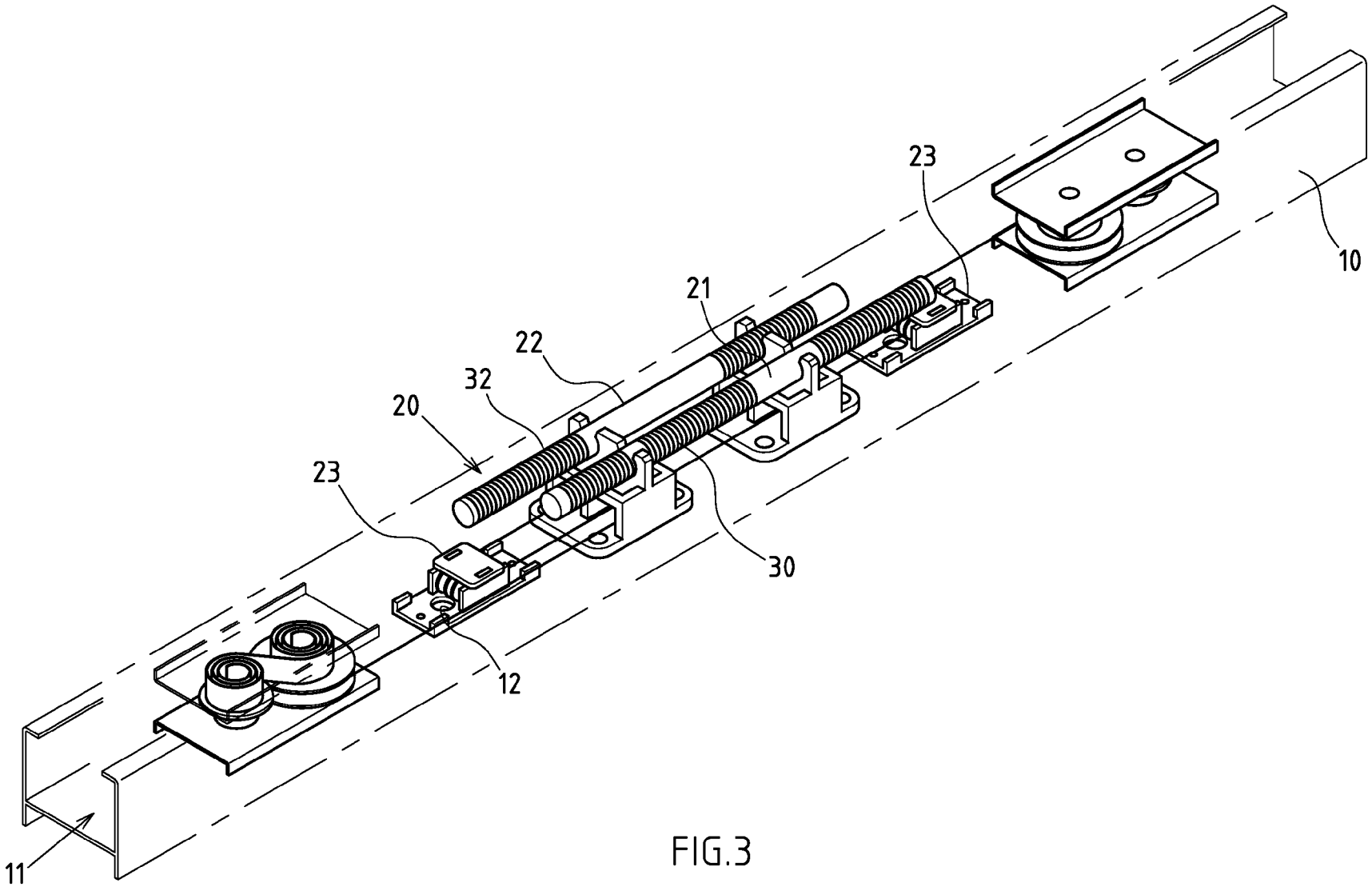
FIG. 3 is perspective view of the fixed top base of the present invention.
Figure 4:
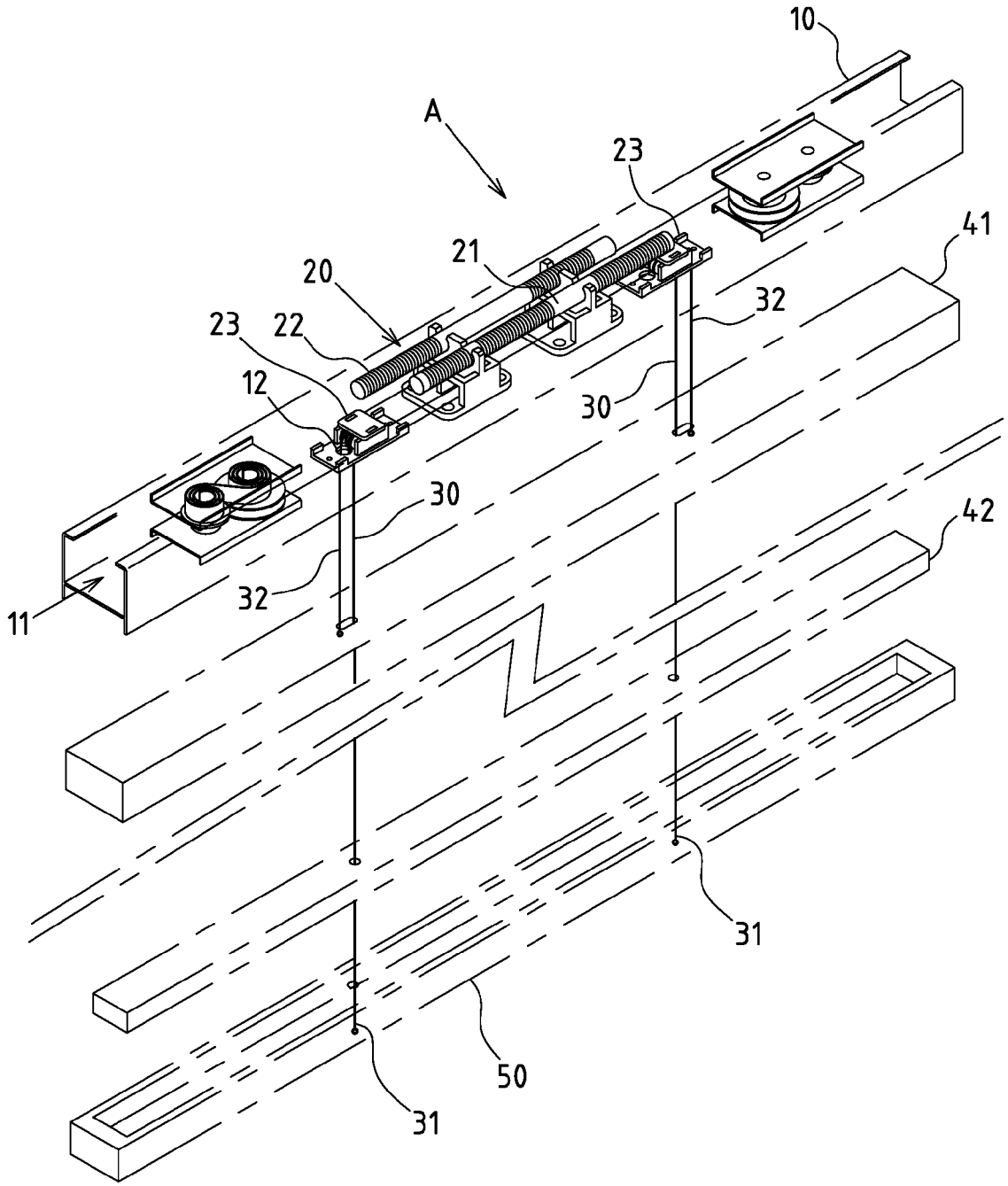
FIG. 4 is schematic diagram of the connection relationships between the first and the second thread and the coil rope control device, curtain and pulling base of this invention.

Please refer to FIGS. 2, 3 and 4 for better implementation cases of this improved structure of two-way up-down curtain. The implementation cases are for illustration only and the patent application is not limited to this structure.

The aforementioned two-way up-down curtain A can be a Roman curtain, blind and so on, and composed is of a fixed top base 10, transverse long extension type. The fixed top base 10 contains a device space 11 and its bottom is drilled several eyelets 12.

A coil rope control device 20 is located in the device space 11 of the fixed top base 10, and it is coiled with at least a first thread 30 and at least a second thread. The aforementioned first and second thread 30, 32 thread out of the eyelet 12 in the bottom of fixed top base 10.

Figure 5:
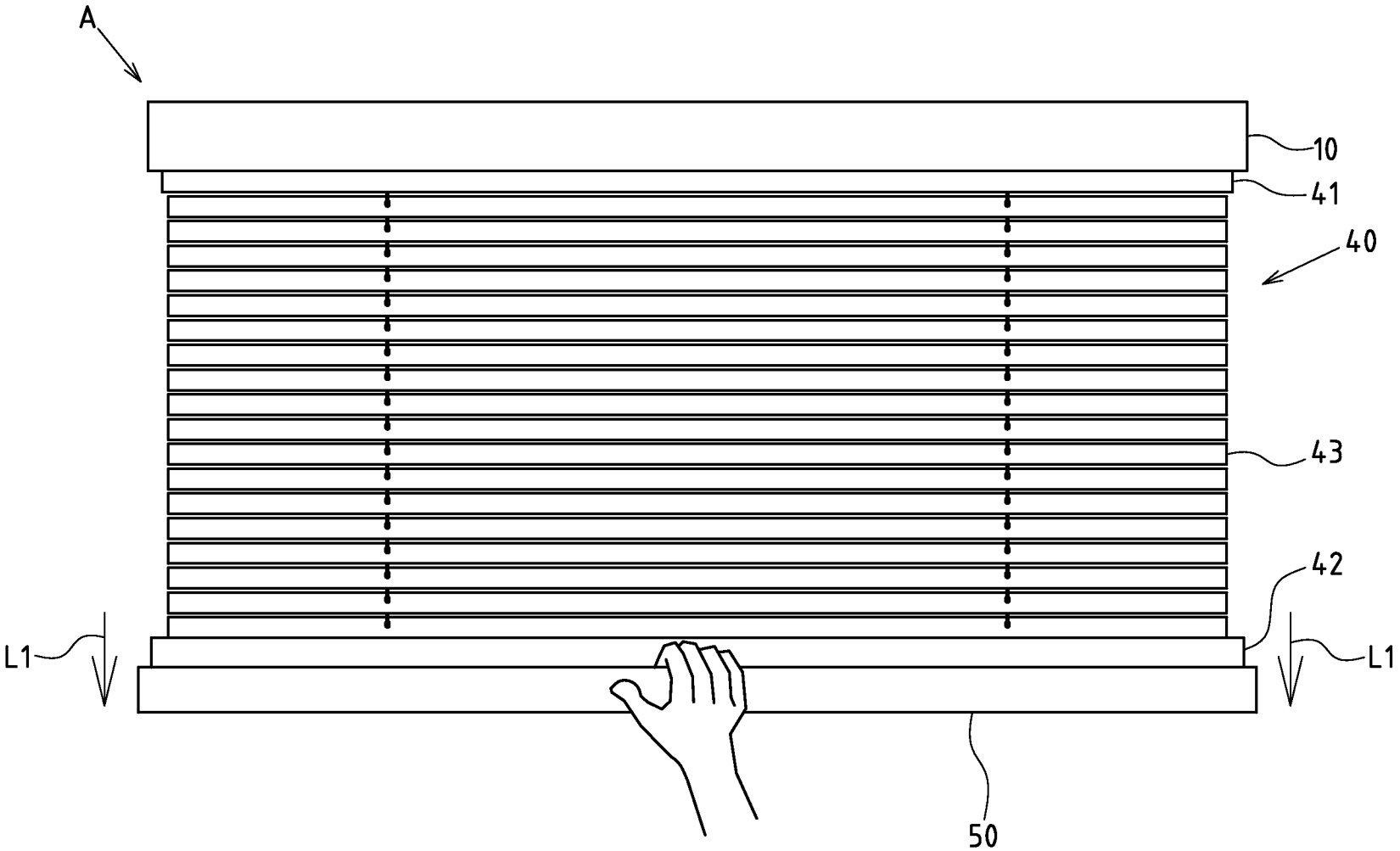
FIG. 5 shows actuation of the operating the pulling base to expand the curtain downwards.

A curtain 40 is provided under the fixed top base 10 and composed of a mobile top 41, a bottom 42 and a curtain 43 between the mobile top 41 and bottom 42. The aforementioned first thread 30 penetrates through the mobile top 41, curtain 43 and bottom 42 downwards, and the first thread 30 threads out of the bottom 42 downwards with an extended end 31, and the second thread 32 is fixed to the mobile top 41. As shown in FIGS. 2 and 5, the mobile top 41 and bottom 42 can be transverse bars connected to the curtain 43.

Figure 7:
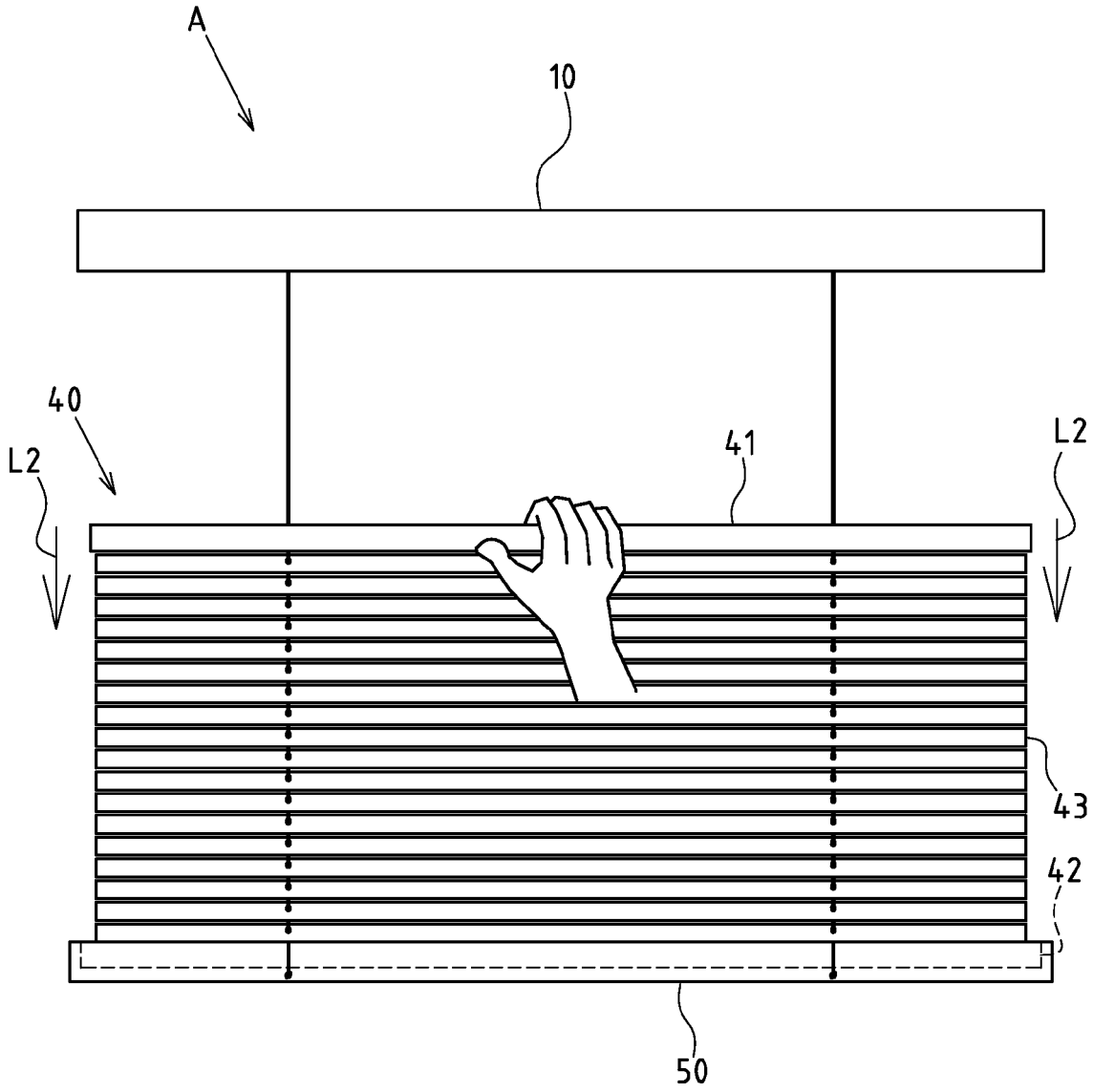
FIG. 7: actuation of operating the mobile top to unfold and fold the curtain.

A pulling base 50 is provided under the bottom 42 of curtain 40, only fixed to the extended end 31 of the first thread 30 mutually, so that the user can change the state of the curtain 43 by pushing and pulling the mobile top 41 or pulling the bottom base 50. As shown in FIG. 5, the curtain 43 is unfolded downwards when the pulling base 50 is pulled (see arrow L1). In addition, as shown in FIG. 7, the curtain 43 is folded downwards when the mobile top 41 is pulled (see arrow L2), so that the sunlight can be shielded when it shoots into the room through the window bottom (e.g. at dusk), and the room will not be dark or improperly ventilated. Comparatively speaking, the state of curtain 43 can be changed by pushing the mobile top 41 upwards or pulling the base 50, it is not detailed herein.

As shown in FIGS. 3 and 4, the coil rope control device 20 comprises of at least a first coil rope axle 21, a second coil rope axle 22 and two roller seats 23. The first and second coil rope axle 21, 22 are separate pivot assemblies in the fixed top base 10 and are rotatable, the two roller seats 23 are located on both sides of the first and second coil rope axle 21, 22. As shown in FIG. 4, the first thread 30 coils round the first coil rope axle 21, and the second thread 32 coils round the second coil rope axle 22, the first and second thread 30, 32 penetrate through roller seat 23 out of the eyelet 12 in the bottom of fixed top base 10, and the second thread 32 is fixed to the mobile top 41. The first thread 30 penetrates through the mobile top 41, curtain 43 and bottom 42 downwards and is fixed to the pulling base 50. Thereby, when the pulling base 50 is pushed or pulled, the first coil rope axle 21 rotates accordingly, and the first thread 30 is drawn or released. When the mobile top 41 is pulled, the second coil rope axle 22 rotates accordingly, and the second thread 32 is drawn or released. Thus, the two-way up-down curtain A can be unfolded and folded in two ways or the curtain 43 can be spread.

Figure 1:
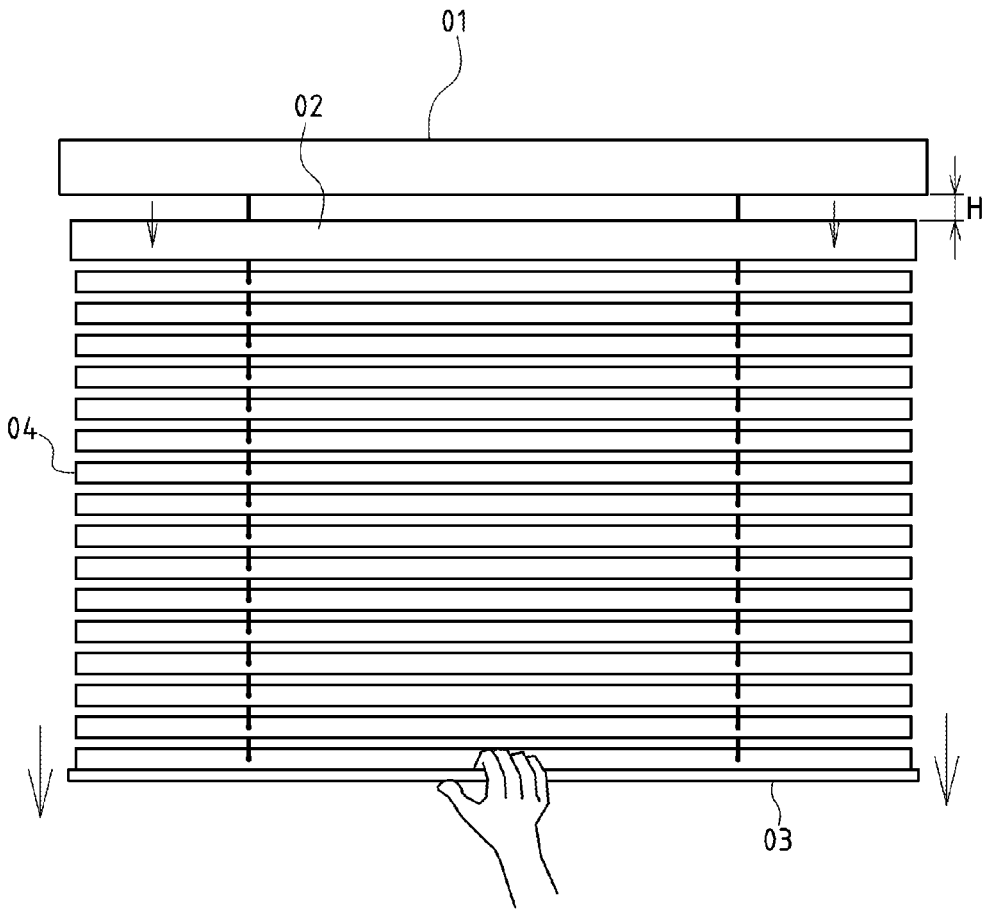
FIG.1 PRIOR ART
FIG. 1 is a view showing operation of the known two-way up-down curtain
Figure 6:
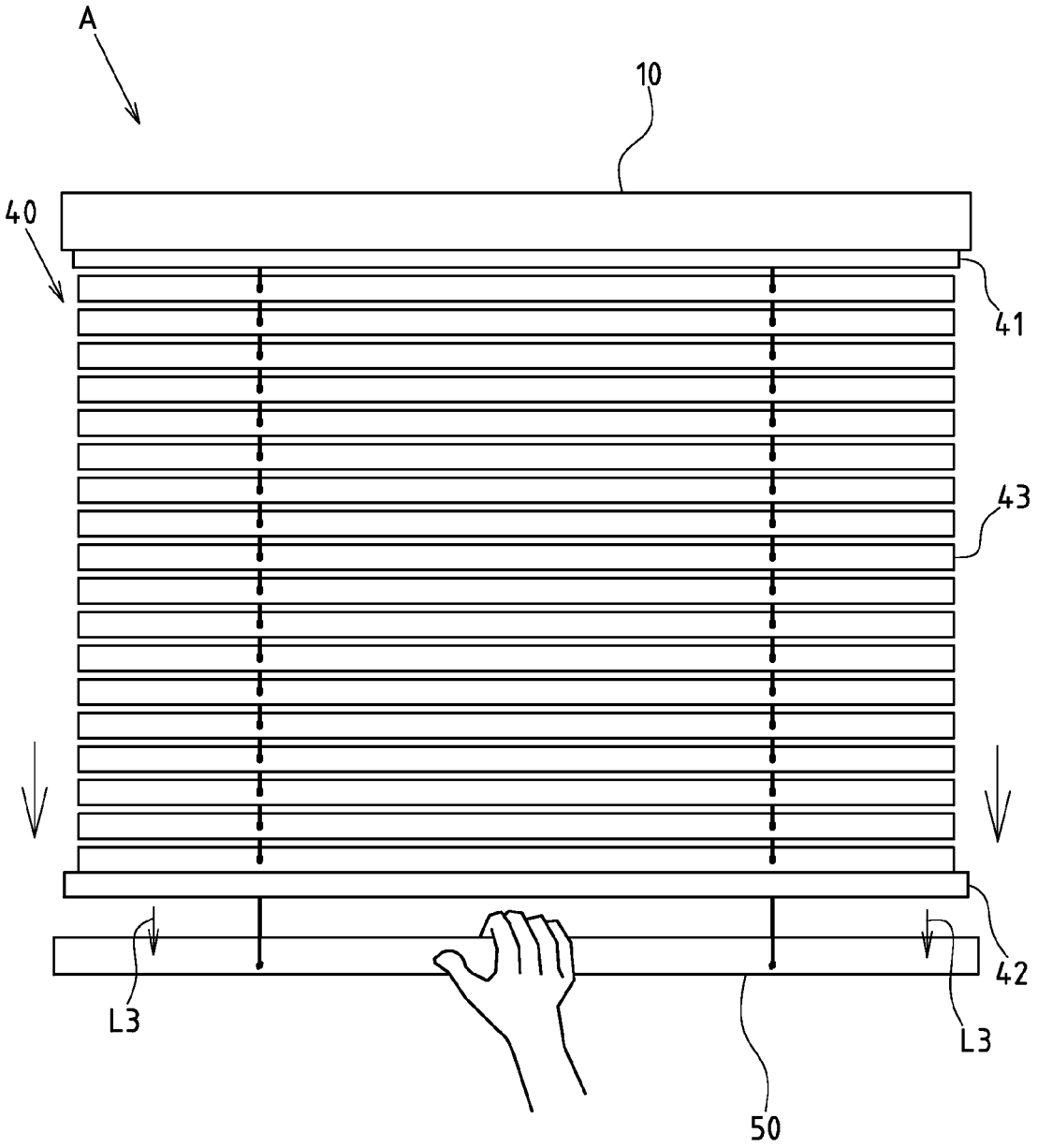
FIG. 6 show actuation of pulling the pulling base downwards when the curtain is fully expanded.

Based on the aforesaid structural composition design, the kernel design of the two-way up-down curtain A of this invention is a pulling base 50 at the bottom 42 of the curtain 40, and the pulling base 50 is only fixed to the extended end 31 of the first thread 30 mutually. As shown in FIG. 6, when the user pulls the pulling base 50 to fully expand the curtain 43 downwards, if he continues to apply force to the pulling base 50 (see arrow L3, applying a downward force to the pulling base 50 as a natural action or in order to make sure the curtain 43 cannot be unfolded anymore), only the first thread 30 will be pulled, the curtain 43 and mobile top 41 will not be pulled (because the pulling base 50 is only fixed to the first thread 30, not connected to the curtain 43). Therefore, in comparison to the known connection between the structure bottom 03 and curtain 04 (please refer to FIG. 1), this invention actually prevents the mobile top 41 from moving to result in a clearance to the fixed top base 10, so that the user does not need to adjust the mobile top 41 upwards to dispose of the clearance anymore, and it is more convenient and practical.

We claim:

1. A two-way top-down and bottom-up curtain apparatus comprising:

an elongated fixed top base having a channel defining a space therein, said top base having a lower surface, said lower surface having a plurality of eyelets formed therethrough;

a coil rope control device positioned in said channel and above said lower surface of said top base, said coil rope control device having a first axle and a second axle rotatably mounted in said channel;

a first thread wrapped around said first axle and extending through one eyelet of said plurality of eyelets;

a second thread wrapped around said second axle and extending through another of said plurality of eyelets;

a curtain assembly positioned under said top base, said curtain assembly having a mobile top and a bottom and a curtain positioned between said mobile top and said bottom, said top base not directly connected to said curtain, said first thread penetrating through said mobile top and said curtain, said first thread having an extended end extending through said bottom, said second thread affixed to said mobile top; and a pulling base positioned below said bottom of said curtain assembly and not directly connected to said bottom or said curtain, said extended end of said first thread affixed to said pulling base, said pulling base configured for manual movement between an elevated position and a lowered position, said first thread coiling around said first axle as said pulling base moves from said lowered position to said elevated position, said second thread being in a stationary position on said second axle as said pulling base moves from said lower position to said elevated position, said second thread uncoiling from said second axle when said mobile top is manually moved from an upper position to a lower position, said first thread being stationary on said first coil as said mobile top moves from said upper position to said lower position.

2. The curtain apparatus of claim 1, further comprising:

a first roller seat positioned adjacent one end of said coil rope control device, said first thread extending through said first roller seat; and a second roller seat positioned adjacent an opposite end of said coil rope control device, said second thread extending through said second roller seat.

3. The curtain apparatus of claim 1, said mobile top and said bottom being bars connected to said curtain.

* * * * *